US007793448B1

(12) United States Patent
Huang et al.

(10) Patent No.: US 7,793,448 B1
(45) Date of Patent: Sep. 14, 2010

(54) DISPLAY MODULE AND ILLUMINATION SIGN DEVICE USING THE SAME

(75) Inventors: Tai-Sheng Huang, Taipei-Hsien (TW); Chia-Huang Chang, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/477,267

(22) Filed: Jun. 3, 2009

(30) Foreign Application Priority Data

Apr. 10, 2009 (CN) ..... 2009 1 0301486

(51) Int. Cl.
*G09F 13/18* (2006.01)

(52) U.S. Cl. ..... 40/546; 362/294; 362/295

(58) Field of Classification Search ..... 40/546, 40/541; 362/600–604, 612–616
See application file for complete search history.

(56) References Cited

U.S. PATENT DOCUMENTS 5,124,890 A * 6/1992 Choi et al. ..... 362/27
5,743,616 A * 4/1998 Giuliano et al. ..... 362/612
6,308,444 B1 * 10/2001 Ki ..... 40/546
7,024,809 B1 * 4/2006 Poma ..... 40/546
7,570,321 B2 * 8/2009 Takahashi et al. ..... 349/65

* cited by examiner

*Primary Examiner*—Lesley Morris
*Assistant Examiner*—Shin Kim
(74) *Attorney, Agent, or Firm*—Clifford O. Chi

(57) ABSTRACT

A display module includes a first light guide plate, a first light shielding sheet disposed above the first light guide plate, a first light source positioned adjacent to the first light guide plate, a second light shielding sheet disposed under the first light guide plate, a second light guide plate disposed under the second light shielding sheet, and a second light source positioned adjacent to the second light guide plate. The first and second light sources emit different color light. The first light shielding sheet defines a first light transmitting pattern. The second light shielding sheet defines a second light transmitting pattern according to the first light transmitting pattern. An area of the second light transmitting pattern is less than that of the first light transmitting pattern.

14 Claims, 5 Drawing Sheets

DISPLAY MODULE AND ILLUMINATION SIGN DEVICE USING THE SAME

BACKGROUND

1. Technical Field

The present disclosure relates to display modules and, particularly, to a display module used in an illumination sign device.

2. Description of the Related Art

A typical illumination sign device includes a housing, a transparent protecting panel, and a simple display module. The housing defines an opening. The display module is disposed in the housing to illuminate sign patterns via the opening. The transparent protecting panel is fixed to the housing at the opening to protect the display module.

A typical display module of the illumination sign device includes a light shielding sheet, a light source, and a light guide plate disposed under the light shielding sheet. The light shielding sheet defines a light transmitting pattern. In use, light emitted from the light source enters the light guide plate and is scattered or refracted in the light guide plate. Eventually, the light is emitted from the light guide plate, with much of the light passing through the light transmitting pattern of the light shielding sheet. Thus, the light transmitting pattern is lighted. However, the typical illumination sign device can only show a simple color of the lighted transmitting pattern.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
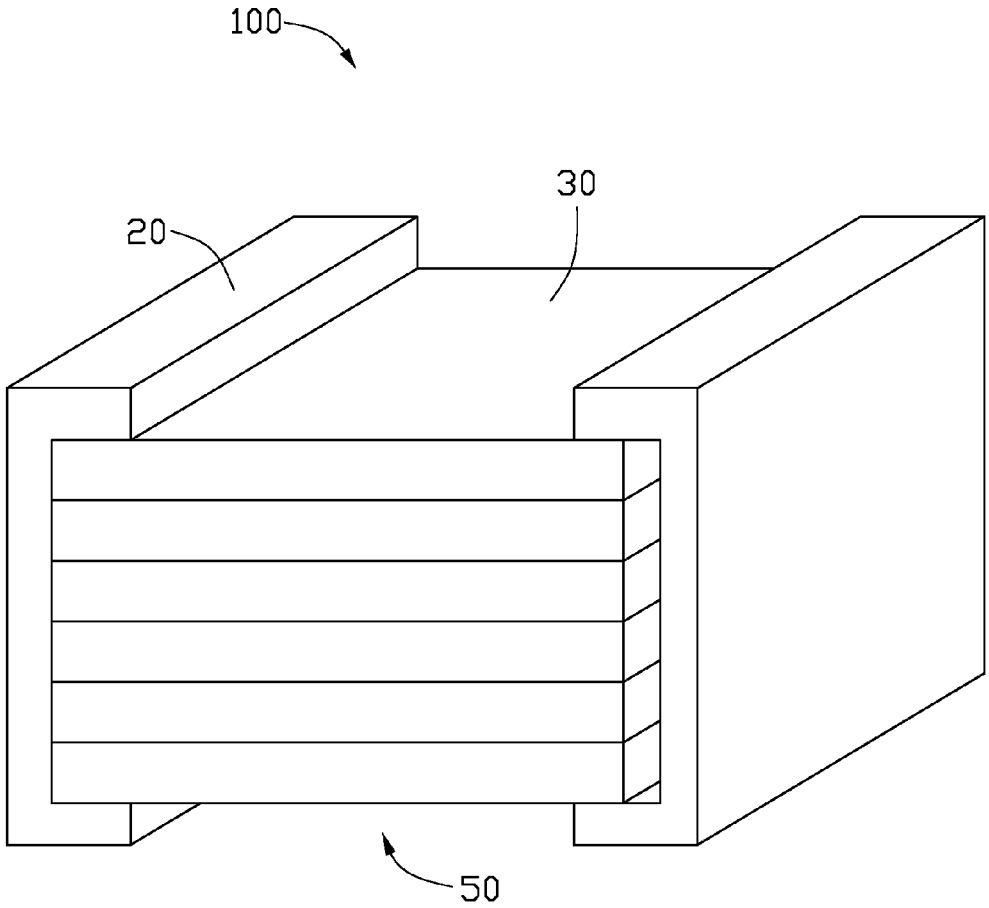
FIG. 1 is an assembled, isometric view of a first embodiment of an illumination sign device including an embodiment of a display module including a first light guide plate.

Referring to FIG. 1, a first embodiment of an illumination sign device 100 includes a frame 20, a transparent protecting plate 30, and a display module 50. The transparent protecting plate 30 is positioned above the display module 50 to protect the display module 50. The transparent protecting plate 30 and the display module 50 are fixed in the frame 20. In the illustrated embodiment, the illumination sign device 100 is a call-in assist module of a mobile phone.

Figure 2:
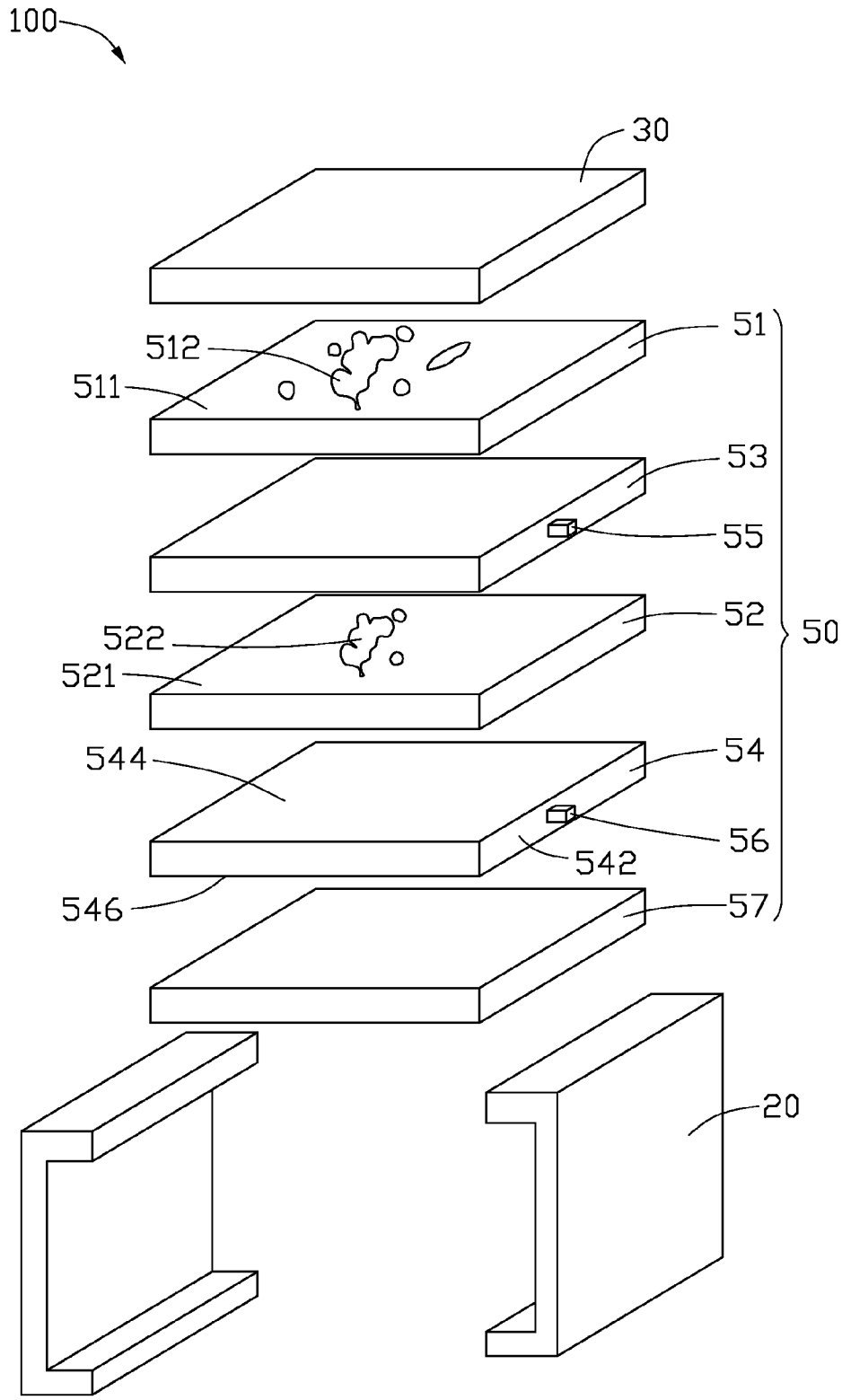
FIG. 2 is an exploded view of the illumination sign device shown in FIG. 1.
Figure 3:
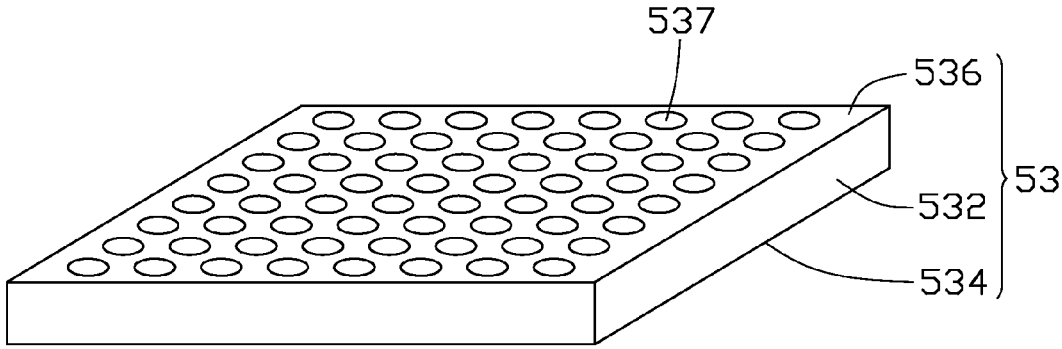
FIG. 3 is an enlarged, isometric view of the first light guide plate shown in FIG. 1, but viewed from another aspect.

Referring to FIGS. 2 and 3, the display module 50 includes a first light shielding sheet 51, a second light shielding sheet 52, a first light guide plate 53, a second light guide plate 54, a first light source 55, a second light source 56, and a reflective sheet 57. The reflective sheet 57, the second light guide plate 54, the second light shielding sheet 52, the first light guide plate 53, and the first light shielding sheet 51 are stacked in that order.

The first light shielding sheet 51 is near the transparent protecting plate 30. The first light shielding sheet 51 includes a light shielding surface 511 and a first light transmitting pattern 512 defined in the light shielding surface 511. The first light transmitting pattern 512 may be any predetermined pattern or configuration. In this embodiment, the first transmitting pattern 512 is a flower with a pair of leaves (see FIG. 4).

The first light guide plate 53 is disposed under the first light shielding sheet 51. The first light guide plate 53 includes a light input surface 532, a light output surface 534, and a bottom surface 536. The light output surface 534 and the bottom surface 536 are on opposite sides of the first light guide plate 53. The light output surface 534 faces the first light shielding sheet 51. The light input surface 532 adjoins the light output surface 534 and the bottom surface 536. The bottom surface 536 defines a plurality of first microstructures 537. The first light source 55 is positioned adjacent to the light input surface 532 of the first light guide plate 53. In the illustrated embodiment, the first light source 55 is a colored light emitting diode (LED).

The second light shielding sheet 52 is disposed under the first light guide plate 53. The second light shielding sheet 52 includes a light shielding surface 521 and a second light transmitting pattern 522 defined in the light shielding surface 521 according to the first light transmitting pattern 512. The second light transmitting pattern 522 is similar to the first light transmitting pattern 512, except that an area of the second light transmitting pattern 522 is smaller than that of the first light transmitting patter 512. The light shielding surface 521 of the second light shielding sheet 52 faces the bottom surface 536 of the first light guide plate 53.

The second light guide plate 54 is disposed under the second light shielding sheet 52. The second light guide plate 54 is similar to the first light guide plate 53. The second light guide plate 54 includes a light input surface 542, a light output surface 544, and a bottom surface 546. The light output surface 544 and the bottom surface 546 are on opposite sides of the second light guide plate 54. The light output surface 544 faces the second light shielding sheet 52. The light input surface 542 adjoins the light output surface 544 and the bottom surface 546. The bottom surface 546 of the second light guide plate 54 may define a plurality of second microstructures (not shown). The second light source 56 is positioned adjacent to the light input surface 542 of the second light guide plate 54. In the illustrated embodiment, the second light source 56 is a colored LED. The first and second light sources 55, 56 emit different color light.

The reflecting sheet 57 is disposed under the second light guide plate 54 to reflect light towards the first light shielding sheet 51.

In use, first color light emitted from the second light source 56 enter the second light guide plate 54 via the light input surface 542, and some of the first color light are reflected back into the second light guide plate 54 by the reflective sheet 57. Some of the first color light exits the second light guide plate 54 via the light output surface 544, in which a portion of the first color light is reflected back to the second light guide plate 54 by the second light shielding sheet 52, and the rest of the first color light travels through the second light transmitting pattern 522. At the same time, second color light emitted from the first light source 55 enter the first light guide plate 53 via the light input surface 532, and some of the first color light are reflected back into the first light guide plate 53 via the bottom surface 536 from the second light transmitting pattern 522.

Figure 4:
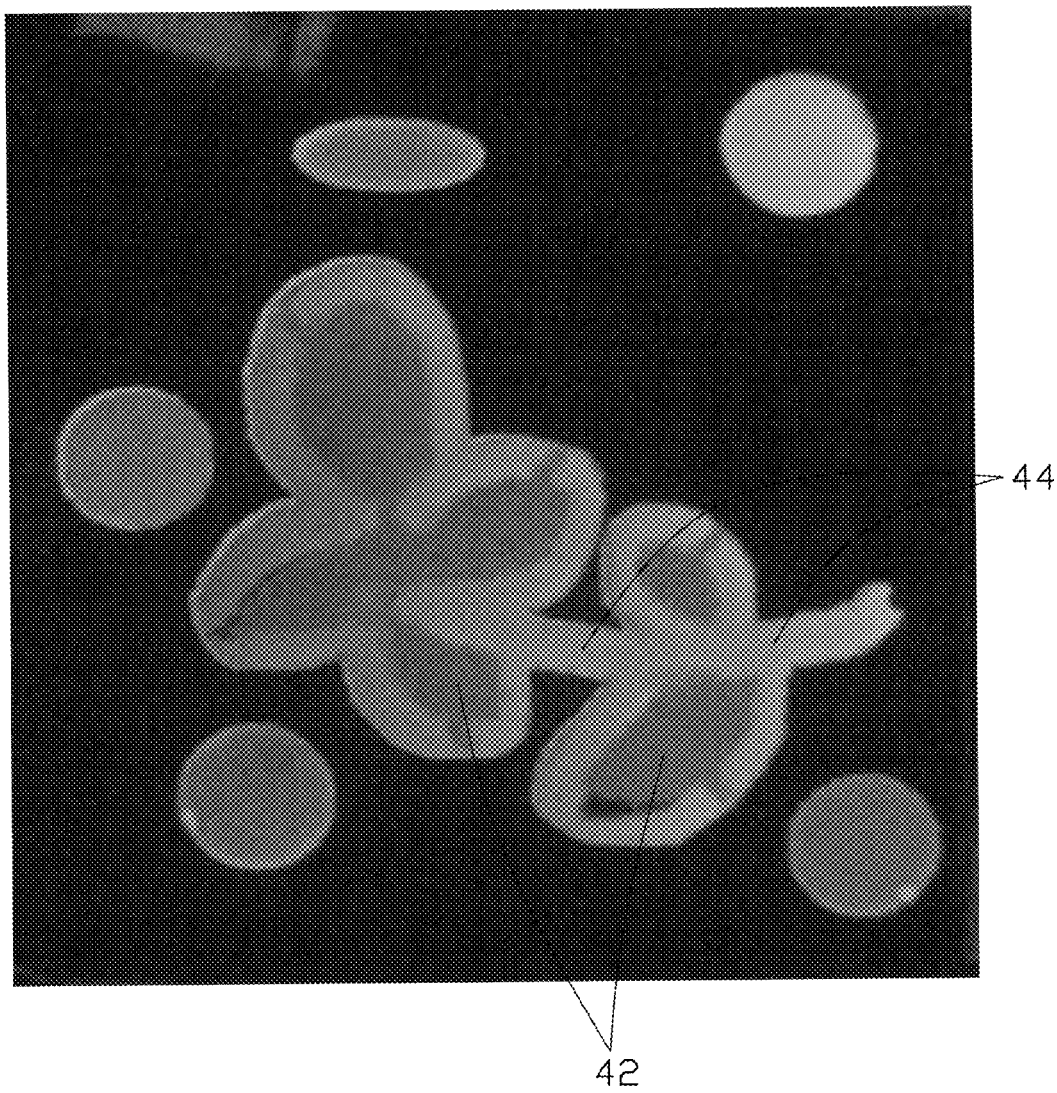
FIG. 4 is a black-ink photo of the illumination sign device of FIG. 1, showing a pattern having two colors.

Referring to FIG. 4, because the area of the first light transmitting pattern 512 is larger than that of the second light transmitting pattern 522, the first color light exits the first light transmitting pattern 512 directly, such that the first and second color light mixes to form a first color pattern 42. Some of the second color light become scattered or refracted by the first microstructures 537 of the bottom surface 536, and exit the first light transmitting pattern 512 without mixing with the first color light rays. Thus, a second color pattern 44 is formed. In this embodiment, the second color pattern 44 surrounds the first color pattern 42.

Figure 5:
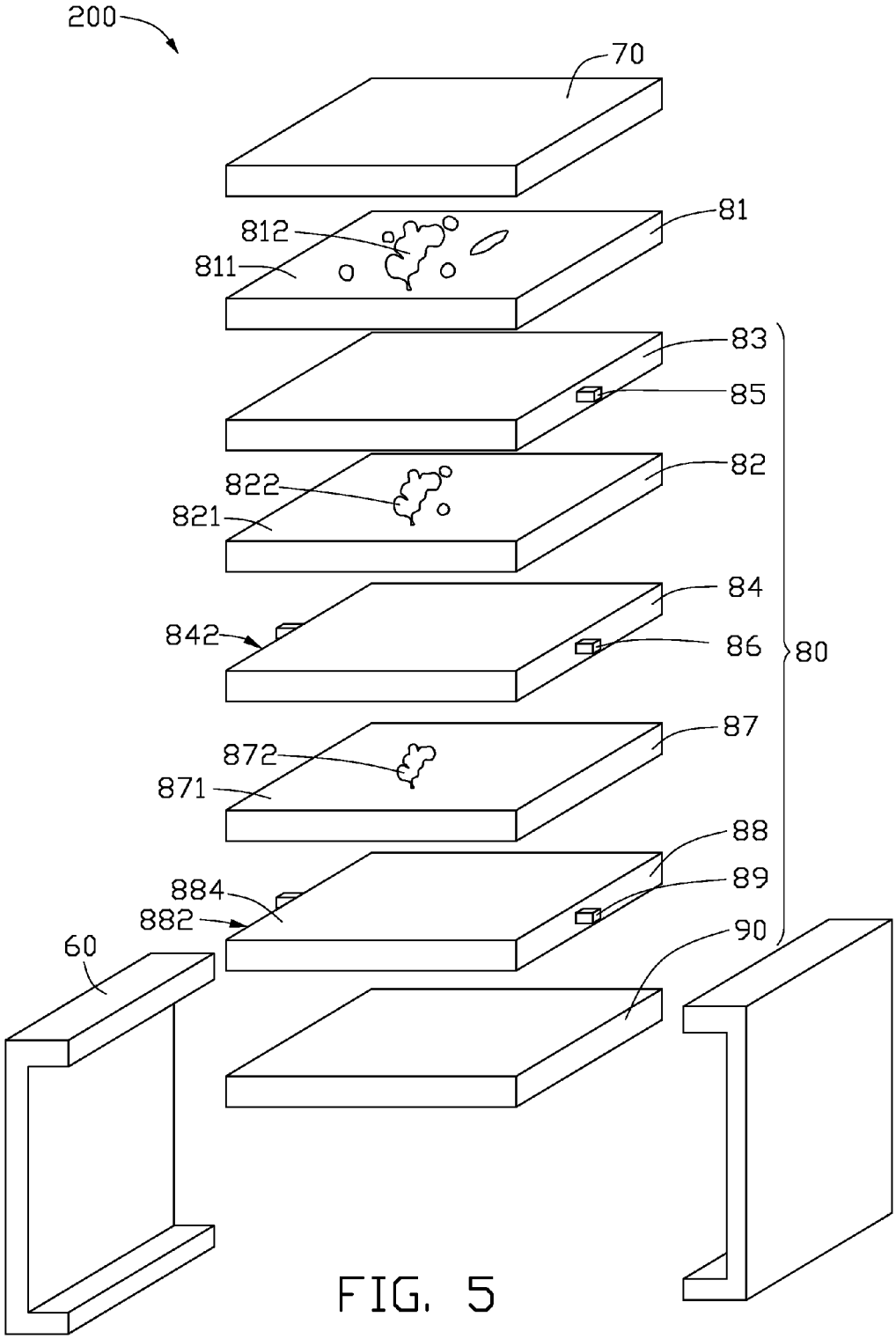
FIG. 5 is an exploded, isometric view of a second embodiment of an illumination sign device.

Referring to FIG. 5, a second embodiment of an illumination sign device 200 includes a frame 60, a transparent protecting plate 70, and a display module 80. The illumination sign device 200 is similar to the illumination sign device 100, except the display module 80 is slightly different. The display module 80 includes a first light shielding sheet 81, a second light shielding sheet 82, a first light guide plate 83, a second light guide plate 84, a first light source 85, two second light sources 86, a third light shielding sheet 87, a third light guide plate 88, two third light sources 89, and a reflective sheet 90. The third light shielding sheet 87 and the third light guide plate 88 are located between the second light guide plate 84 and the reflective sheet 90 in that order. The second light guide plate 84 includes two opposite light input surfaces 842. The two second light sources 86 are disposed near the two light input surfaces 842, respectively. The third light guide plate 88 includes two opposite light input surfaces 882. The two third light sources 89 are disposed near the two light input surfaces 882, respectively.

The third light shielding sheet 87 defines a third light transmitting pattern 872 according to a second light transmitting pattern 822 of the second light shielding sheet 82. The third light transmitting pattern 872 is similar to the second light transmitting pattern 822, except that an area of the third light transmitting pattern 872 is less than that of the second light transmitting pattern 822. The second embodiment of the illumination sign device 200 has a three color pattern.

It should be pointed out that the illumination sign devices 100, 200 may be used as adverting boards, traffic signs, automobile symbols, and so on.

Finally, while the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure as defined by the appended claims.

What is claimed is:

1. A display module, comprising:

a first light guide plate comprising a first light output surface, a first bottom surface opposite to the first light output surface, and a first light input surface adjoining the first light output surface and the first bottom surface;

a first light shielding sheet disposed above the first light output surface of the first light guide plate;

a first light source positioned adjacent to the first light input surface of the first light guide plate;

a second light shielding sheet disposed under the first light guide plate;

a second light guide plate disposed under the second light shielding sheet, the second light guide plate comprising a second light output surface, a second bottom surface opposite to the second light output surface, and a second light input surface adjoining the second light output surface and the second bottom surface; and a second light source positioned adjacent to the second light input surface of the second light guide plate, wherein the first and second light sources emit different color light; the first light shielding sheet defines a first light transmitting pattern, the second light shielding sheet defines a second light transmitting pattern according to the first light transmitting pattern, and an area of the second light transmitting pattern is less than that of the first light transmitting pattern.

2. The display module of claim 1, wherein the first and second light sources are three-colored light emitting diodes.

3. The display module of claim 1, further comprising a reflective sheet disposed under the second light guide plate to reflect light towards the first light shielding sheet.

4. The display module of claim 3, further comprising a third light shielding sheet, a third light guide plate and a third light source, wherein the third light shielding sheet and the third light guide plate are positioned between the second light guide plate and the reflective sheet, the third light guide plate is disposed under the third light shielding sheet, the third light guide plate has a third light input surface, the third light source is positioned adjacent to the third light input surface, the third light shielding sheet defines a third light transmitting pattern according to the second light transmitting pattern, and an area of the third light transmitting pattern is less than that of the second light transmitting pattern of the second light shielding sheet.

5. The display module of claim 4, wherein the third light source emits different color light from the first and second light sources.

6. The display module of claim 4, wherein the first bottom surface of the first light guide plate defines a plurality of first microstructures.

7. The display module of claim 4, wherein the second bottom surface of the second light guide plate defines a plurality of second microstructures.

8. An illumination sign device, comprising:

a frame;

a transparent protecting plate;

a display module positioned under the transparent protecting plate, the transparent protecting plate and the display module being fixed in the frame, the display module comprising:

a first light guide plate comprising a first light output surface, a first bottom surface opposite to the first light output surface, and a first light input surface adjoining the first light output surface and the first bottom surface;

a first light shielding sheet disposed above the first light output surface of the first light guide plate;

a first light source positioned adjacent to the first light input surface of the first light guide plate;

a second light shielding sheet disposed under the first light guide plate;

a second light guide plate disposed under the second light shielding sheet, the second light guide plate comprising a second light output surface, a second bottom surface opposite to the second light output surface, and a second light input surface adjoining the second light output surface and the second bottom surface; and a second light source positioned adjacent to the second light input surface of the second light guide plate, wherein the first and second light sources emit different color light; the first light shielding sheet defines a first light transmitting pattern, the second light shielding sheet defines a second light transmitting pattern according to the first light transmitting pattern, and an area of the second light transmitting pattern is less than that of the first light transmitting pattern.

9. The illumination sign device of claim 8, wherein the first and second light sources are three-colored light emitting diodes.

10. The illumination sign device of claim 8, further comprising a reflective sheet disposed under the second light guide plate to reflect light towards the first light shielding sheet.

11. The illumination sign device of claim 10, further comprising a third light shielding sheet, a third light guide plate and a third light source, wherein the third light shielding sheet and the third light guide plate are positioned between the second light guide plate and the reflective sheet, the third light guide plate is disposed under the third light shielding sheet, the third light guide plate has a third light input surface, the third light source is positioned adjacent to the third light input surface, the third light shielding sheet defines a third light transmitting pattern according to the second light transmitting pattern, and an area of the third light transmitting pattern is less than that of the second light transmitting pattern of the second light shielding sheet.

12. The illumination sign device of claim 11, wherein the third light source emits different color light from the first and second light sources.

13. The illumination sign device of claim 11, wherein the first bottom surface of the first light guide plate defines a plurality of first microstructures.

14. The illumination sign device of claim 11, wherein the second bottom surface of the second light guide plate defines a plurality of second microstructures.

* * * * *